US010285498B2

(12) United States Patent
Cohen et al.

(10) Patent No.: US 10,285,498 B2
(45) Date of Patent: May 14, 2019

(54) POWER ACCESS DOOR ASSEMBLY

(71) Applicant: Herman Miller, Inc., Zeeland, MI (US)

(72) Inventors: Jeptha Cohen, Holland, MI (US); David Johnson, Zeeland, MI (US); Michael Katje, Grand Haven, MI (US); Robert Hutton, Providence, RI (US)

(73) Assignee: HERMAN MILLER, INC., Zeeland, MI (US)

( * ) Notice: Subject to any disclaimer, the term of this patent is extended or adjusted under 35 U.S.C. 154(b) by 0 days.

(21) Appl. No.: 15/618,207

(22) Filed: Jun. 9, 2017

(65) Prior Publication Data

US 2017/0354248 A1 Dec. 14, 2017

Related U.S. Application Data

(60) Provisional application No. 62/349,137, filed on Jun. 13, 2016.

(51) Int. Cl.

| | |
|---|---|
| ***A47B 21/06*** | (2006.01) |
| ***E05D 3/12*** | (2006.01) |
| ***E05D 15/04*** | (2006.01) |
| ***E05D 15/48*** | (2006.01) |
| ***E05D 15/40*** | (2006.01) |

(52) U.S. Cl.

CPC ..... *A47B 21/06* (2013.01); *E05D 3/12* (2013.01); *E05D 15/04* (2013.01); *E05D 15/40* (2013.01); *E05D 15/48* (2013.01); *A47B 2021/066* (2013.01); *E05Y 2900/20* (2013.01)

(58) Field of Classification Search

CPC ..... A47B 21/00; A47B 21/21; A47B 21/06; A47B 2037/005; A47B 2200/0013; A47B 2200/008; A47B 2200/0081; A47B 2200/0082; A47B 2021/066; E05D 3/12; E05D 15/04; E05D 15/48; Y10T 16/5474; Y10T 16/5475

USPC ..... 108/50.01, 50.02; 312/223.3, 223.6

See application file for complete search history.

(56) References Cited

U.S. PATENT DOCUMENTS

| | | | |
|---|---|---|---|
| 4,058,066 | A | 11/1977 | Altman |
| 4,792,881 | A | 12/1988 | Wilson et al. |
| 5,231,562 | A | 7/1993 | Pierce et al. |
| 6,028,267 | A | 2/2000 | Byrne |
| 6,085,667 | A | 7/2000 | Gevaert et al. |
| 6,162,071 | A | 12/2000 | Muller |

(Continued)

FOREIGN PATENT DOCUMENTS

| | | | |
|---|---|---|---|
| AT | 506935 | * | 1/2010 |
| AT | 508009 | * | 10/2010 |

(Continued)

*Primary Examiner* — Janet M Wilkens

(74) *Attorney, Agent, or Firm* — Michael Best & Friedrich LLP

(57) ABSTRACT

A power access door assembly for use with a worksurface includes a frame configured to be received within an opening of the worksurface, a hinge coupled to the frame, and a door coupled to the hinge for movement relative to the frame. The door is movable relative to the frame between a first position, in which the door is positioned within a perimeter of the frame and substantially blocks access to the opening, a second position, in which the door is pivoted open relative to the frame, and a third position, in which the door is moved outside the perimeter of the frame.

9 Claims, 12 Drawing Sheets

(56) References Cited

U.S. PATENT DOCUMENTS

| | | | | |
|---|---|---|---|---|
| 6,290,518 | B1 | 9/2001 | Byrne | |
| 6,338,301 | B1 | 1/2002 | Almond | |
| 6,397,762 | B1 | 6/2002 | Goldberg et al. | |
| 6,446,396 | B1 | 9/2002 | Marangoni et al. | |
| 6,553,919 | B1 | 4/2003 | Nevin | |
| 6,578,498 | B1 | 6/2003 | Draudt et al. | |
| 6,588,346 | B1 | 7/2003 | Bockheim et al. | |
| 6,732,661 | B2 | 5/2004 | Grasse et al. | |
| 6,979,209 | B2 | 12/2005 | Griepentrog | |
| 7,073,449 | B2 | 7/2006 | Pipkin | |
| 7,312,393 | B2 | 12/2007 | McCarthy | |
| 7,966,951 | B1 | 6/2011 | Black et al. | |
| 8,074,581 | B2 | 12/2011 | Epstein et al. | |
| 8,082,856 | B1 | 12/2011 | Hayden et al. | |
| 8,720,348 | B2 | 5/2014 | Roh | |
| 8,875,637 | B2 | 11/2014 | Sherman et al. | |
| 8,901,419 | B2 | 12/2014 | Galasso | |
| 8,925,469 | B2 | 1/2015 | Bennie et al. | |
| 8,943,978 | B2 | 2/2015 | Soper et al. | |
| 2004/0075373 | A1* | 4/2004 | Gershfeld | A47B 21/0073 312/223.3 |
| 2004/0187262 | A1* | 9/2004 | Gabathuler | H04R 25/602 16/366 |
| 2005/0268823 | A1 | 12/2005 | Bakker et al. | |
| 2007/0022918 | A1 | 2/2007 | Sweet et al. | |
| 2009/0165679 | A1 | 7/2009 | Bakker et al. | |
| 2010/0024305 | A1* | 2/2010 | Kim | B64C 1/1407 49/208 |
| 2010/0031855 | A1 | 2/2010 | Zhu | |
| 2013/0042435 | A1* | 2/2013 | Schott | E05D 5/062 16/321 |
| 2013/0256492 | A1* | 10/2013 | Liu | F16M 11/24 248/349.1 |
| 2014/0261104 | A1* | 9/2014 | Sherman | A47B 21/06 108/93 |
| 2015/0320203 | A1* | 11/2015 | Mandon | A47B 21/06 108/20 |
| 2017/0135467 | A1* | 5/2017 | Dutertre | A47B 21/06 |

FOREIGN PATENT DOCUMENTS

| | | | |
|---|---|---|---|
| CA | 2407447 | * | 4/2003 |
| DE | 102004008069 | * | 9/2005 |
| DE | 202016003253 | * | 7/2016 |
| EP | 2065992 A1 | | 6/2009 |
| EP | 2154761 A1 | | 2/2010 |
| KR | 101394021 | * | 5/2014 |
| WO | 2015140418 | * | 9/2015 |

* cited by examiner

POWER ACCESS DOOR ASSEMBLY

CROSS-REFERENCE TO RELATED APPLICATIONS

This application claims priority to U.S. Provisional Patent Application No. 62/349,137, filed Jun. 13, 2016, the entire contents of which are incorporated by reference herein.

FIELD OF THE INVENTION

The present invention relates to power access doors, particularly for use on a worksurface.

BACKGROUND

Access to power outlets has become increasingly important due to the number of technology based devices requiring power that are used on a daily basis. A single person working in an office may desire power for several devices at a time, including, for example, a computer, multiple monitors, a light, a printer, a phone (sometimes both a land line and a cell phone), a speaker system, a hot plate, etc. Therefore, additional power outlets are often provided in work spaces to create convenience and easy access to power. For example, additional power outlets may be provided on a desk or other worksurface. Power outlets may be provided on the ground near a chair or under a table.

While the additional power outlets may be convenient at times, they can also be an eye sore and may occupy extra workspace. Accordingly, it may be desirable to hide the power outlets when they are not in use. Furthermore, it may be preferable to hide the power outlets in a manner that interferes as little as possible with the available space on the worksurface.

SUMMARY

In one embodiment, the invention provides a power access door assembly for use with a worksurface. The power access door assembly includes a frame configured to be received within an opening of the worksurface, a hinge coupled to the frame, and a door coupled to the hinge for movement relative to the frame. The door is movable relative to the frame between a first position, in which the door is positioned within a perimeter of the frame and substantially blocks access to the opening, a second position, in which the door is pivoted open relative to the frame, and a third position, in which the door is moved outside the perimeter of the frame.

In another embodiment, the invention provides a power access door assembly for use with a worksurface. The power access door assembly includes a frame configured to be received within an opening of the worksurface, and a hinge including a lever arm having a first end defining a first axis of rotation and a second end defining a second axis of rotation. The second end is coupled to the frame to allow movement of the hinge relative to the frame about the second axis of rotation. The power access door assembly also includes a door coupled to first end of the lever arm to allow movement of the door relative to the frame about the first axis of rotation.

In yet another embodiment, the invention provides a system including an article of furniture having a worksurface, and a power access door assembly supported by the article of furniture. The power access door assembly includes a frame configured to be received within an opening of the worksurface, a hinge coupled to the frame, and a door coupled to the hinge for movement relative to the frame. The door is movable to lay generally flat on the worksurface outside of a perimeter of the frame Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
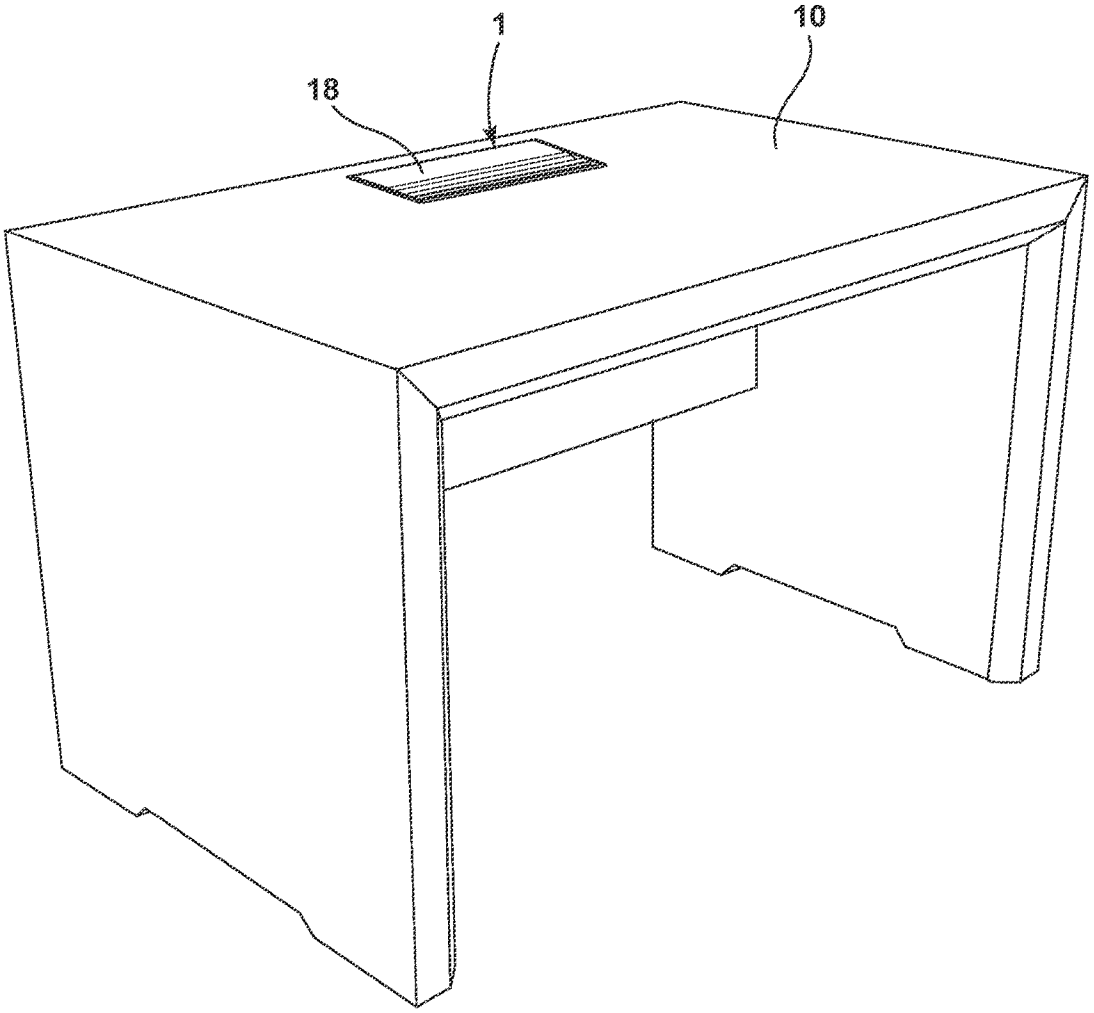
FIG. 1 is a perspective view a worksurface, such as a desk, including a power access door assembly.

FIG. 1 illustrates a power access door assembly 1 that can be used on a worksurface 10, such as a desk or table, to selectively provide access to a power outlet. More specifically, the power access door assembly 1 is inserted into an opening (not shown) in a worksurface 10 where outlets are disposed. When the power outlets are not in use, the power access door assembly 1 can hide the power outlets and create a flat, uniform worksurface 10. However, when power is desired, the power access door assembly 1 can provide access to power outlets on the worksurface 10 so that users can plug in electronic devices at their convenience. In addition, once the electronic devices are plugged in, the power access door assembly 1 can be closed to hide the power outlets and create a flat surface. It should be understood that although the power access door assembly 1 is described with respect to a worksurface 10 of an article of furniture, the power access door assembly 1 may be used on many other surfaces. For example, the power access door assembly 1 may be used within a wall, a side panel of a desk or table, or the floor.

Figure 2:
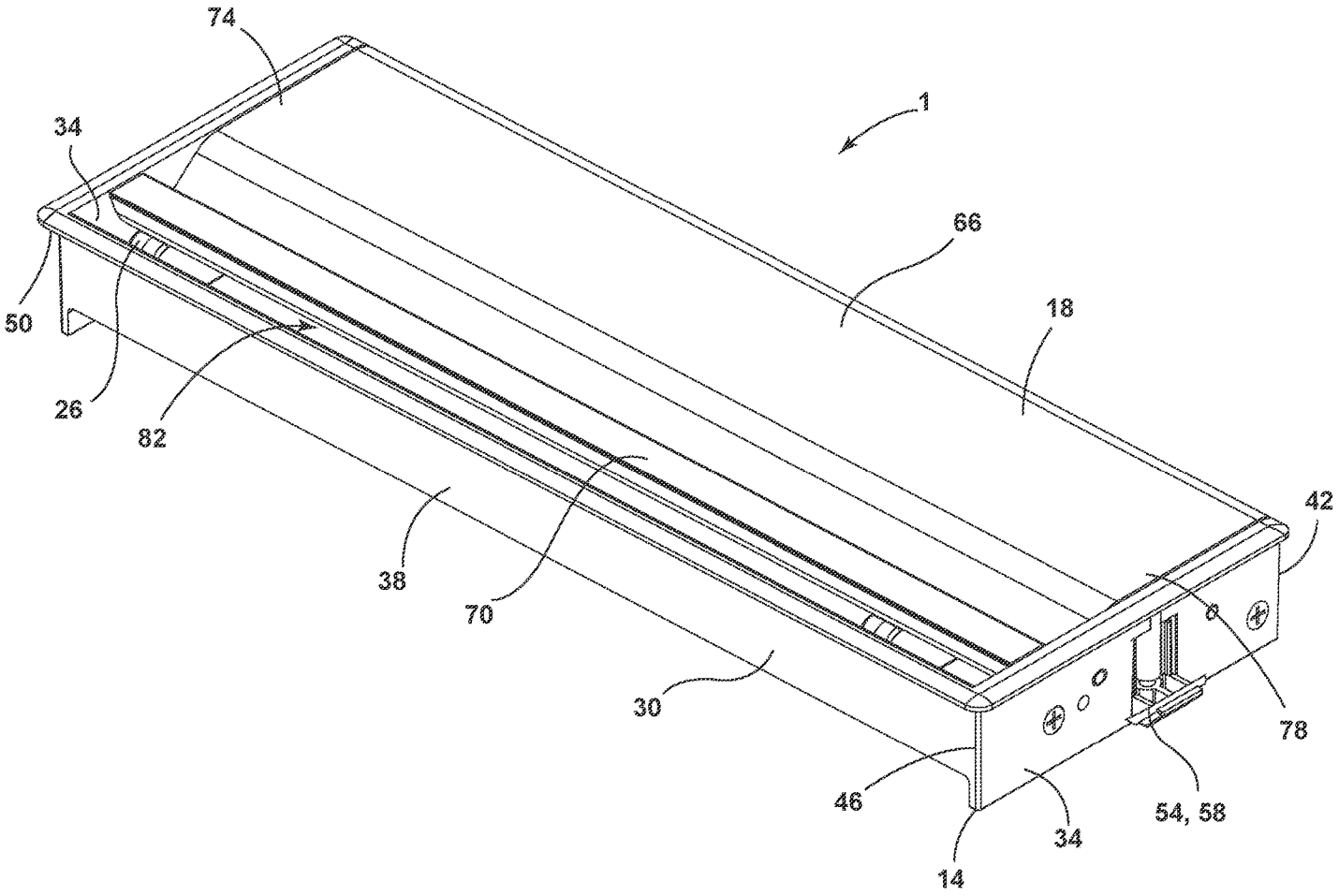
FIG. 2 is a top perspective view of the power access door assembly according to one embodiment of the invention.
Figure 3:
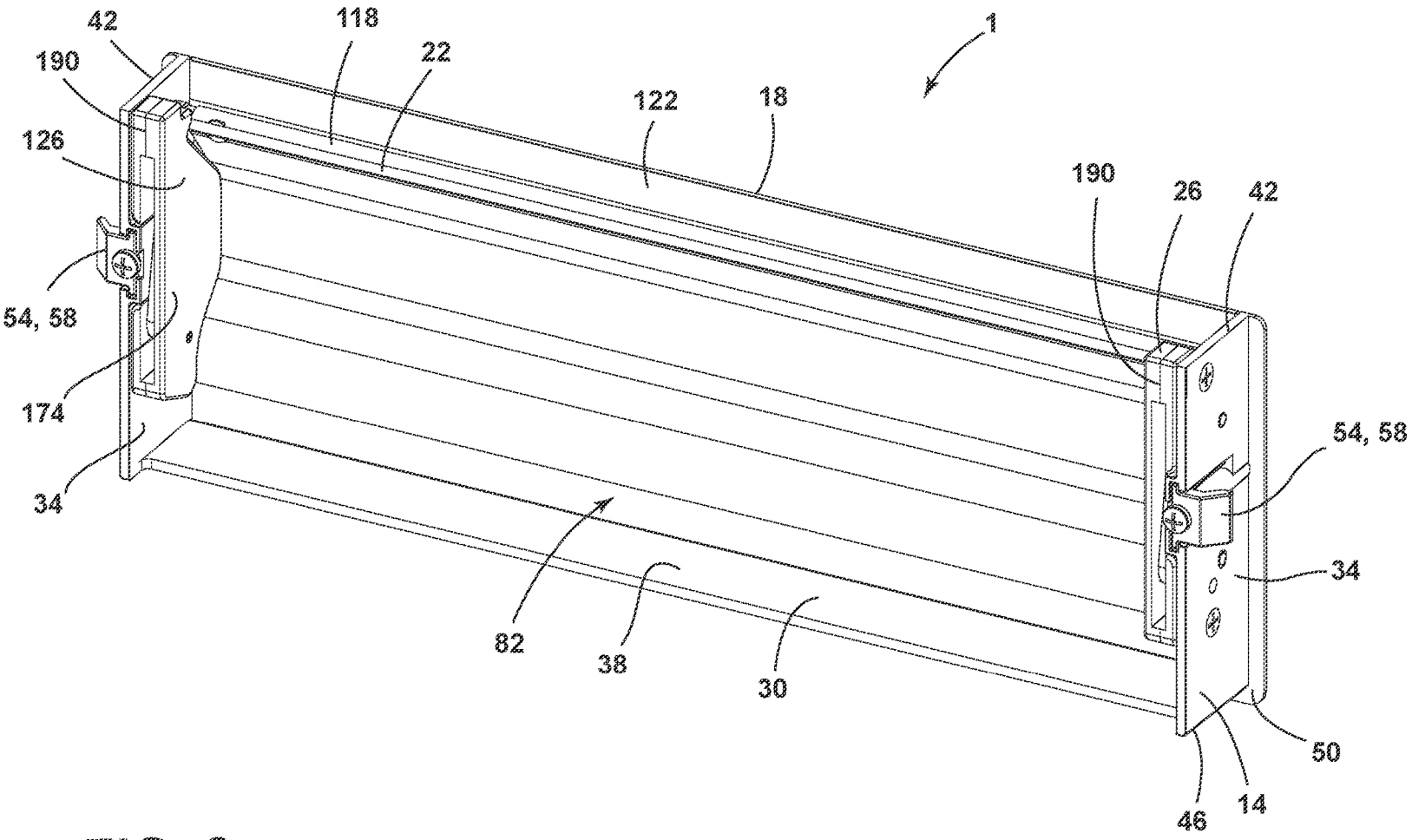
FIG. 3 is a bottom perspective view of the power access door assembly of FIG. 2.
Figure 4:
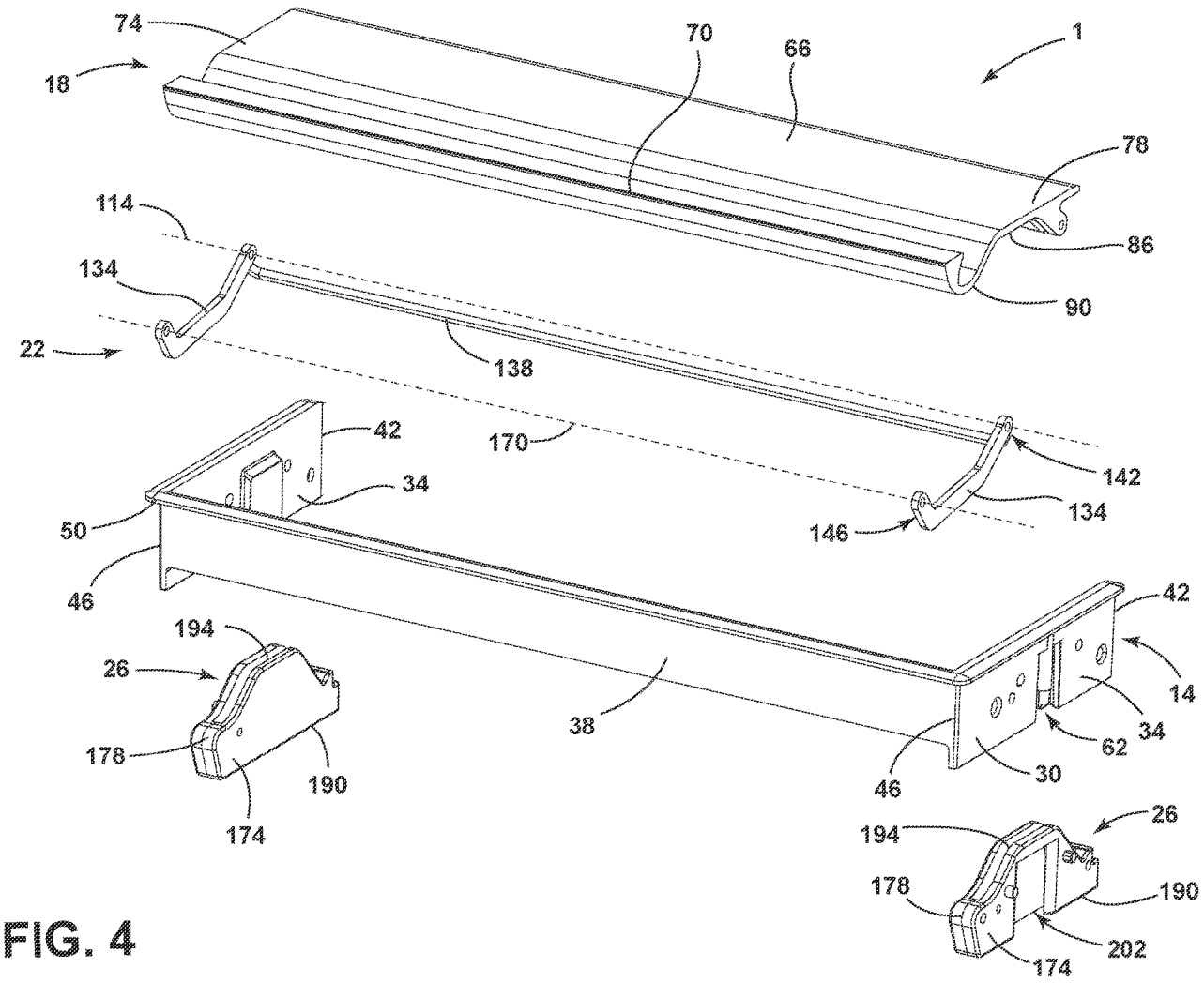
FIG. 4 is an exploded view of the power access door assembly of FIG. 2.

With references to FIG. 2-4, the power access door assembly 1 includes a frame 14, a door 18, a hinge 22, and one or more support members 26. The frame 14 supports the door 18, the hinge 22, and the support members 26 within the worksurface 10. As shown in FIG. 3, the frame 14 includes a generally U-shaped body 30 defined by two side panels 34 and a front panel 38 connecting the side panels 34. More specifically, each side panel 34 has a first end 42 and a second end 46. The front panel 38 connects the first ends 42 of the side panels 34. The side panels 34 extend orthogonally from the front panel 38 with the second ends 46 of the side panels 34 remaining free from one another. The distance between the first end 42 and the second end 46 of the side panel 34 defines the width of the frame 14. Additionally, the side panels 34 are spaced apart to define a length of the frame 14. Together the length and the width define a perimeter of the frame 14.

A lip 50 extends around a top edge of the body 30 of the frame 14. When the frame 14 is inserted into an opening of the worksurface 10, the body 30 extends into the opening while the lip 50 engages with the top surface of the worksurface 10 to prevent the frame 14 from falling through the opening. In addition to the lip 50, the frame 14 may be supported within the opening of the worksurface 10 by one or more fasteners 54. The fasteners 54 can include any type of fastening device that helps support the frame 14 within the opening. For example, the fasteners 54 can be screws, detent mechanisms, spring loaded pins, clips, or the like. In the illustrated embodiment, the fasteners 54 are clips 58 that can be snapped on to the side panels 34 of the frame 14. The clips 58 are received within a recess 62 (FIG. 4) disposed in each of the side panels 34. A portion of each clip 58 extends outside of the recess 62, beyond the side panel 34 to engage a bottom surface (not shown) of the worksurface 10. The lip 50 and the clips 58 work together to hold the frame 14 within the opening of the worksurface 10. Specifically, the body 30 of the frame 14 can be inserted into the opening of the worksurface 10 from the top, with the lip 50 engaging the top surface of the worksurface 10. The clips 58 are then snapped onto the side panels 34 from the underside of the worksurface 10 so that the clips 58 engage the bottom surface of the worksurface 10.

The door 18 is positioned within the perimeter of the frame 14. The door 18 is a plate-like structure having a first end 66, a second end 70, a first side 74, and a second side 78. The distance between the first end 66 and the second end 70 defines the width of the door 18. The first side 74 and the second side 78 extend between the first end 66 and the second end 70 and are spaced apart from one another to define a length of the door 18. In the illustrated embodiment, the length of the door 18 spans the entire length of the frame 14 (i.e., the distance between the sides of the frame 14). However, the width of the door 18 does not span the entire width of the frame 14 (i.e., the distance between the first end 66 and the second end 70 of the side panels 34). As shown in FIGS. 2 and 3, the door 18 only extends part of the frame width, leaving a space 82 within the perimeter of the frame 14. In the illustrated embodiment, the space 82 is proximate the front panel 38. The space 82 enables power cords to pass through the power access door assembly 1 to reach the power outlets while the power access door assembly 1 is closed.

Figure 5:
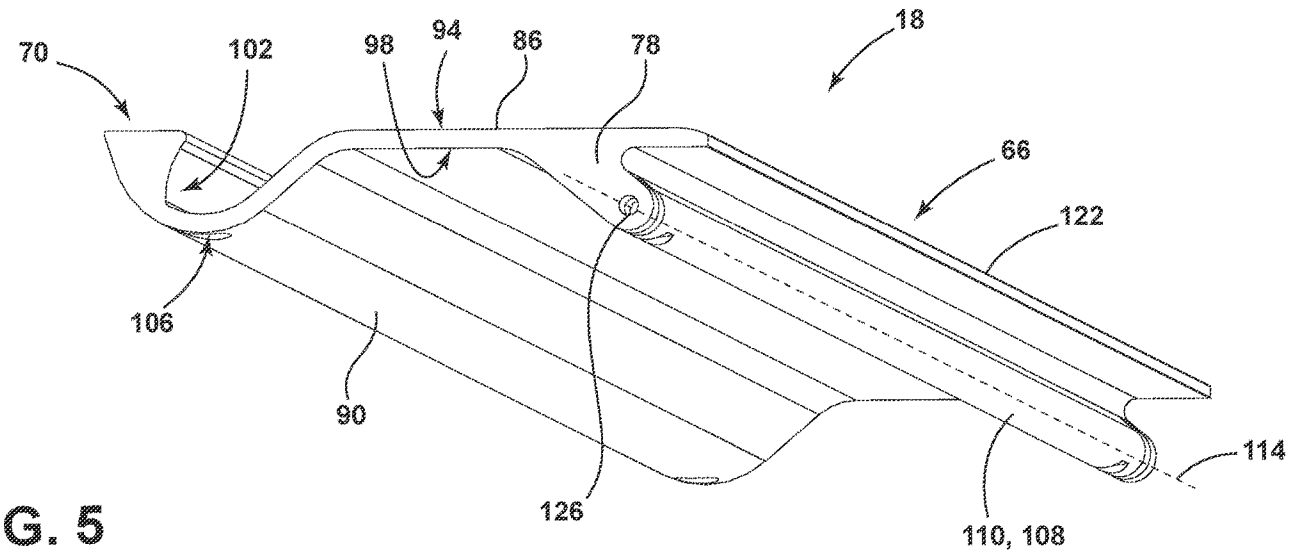
FIG. 5 is a perspective view of a door of the power access door assembly of FIG. 2.

With reference to FIG. 5, the door 18 has a planar portion 86 proximate the first end 66 and a curved portion 90 proximate the second end 70. The planar portion 86 has a top surface 94 and a bottom surface 98 opposite the top surface 94, in which the top surface 94 and the bottom surface 98 are generally parallel. The curved portion 90 bends upward, toward the top surface 94 to form a C-shaped curve when viewed from one of the sides. The curved portion 90 has an inner circumference defining a gripping surface 102 and an outer circumference defining a sloped surface 106. The gripping surface 102 merges with the top surface 94 of the planar portion 86 and the sloped surface 106 merges with the bottom surface 98 of the planar portion 86.

In addition, the door 18 includes a rotational coupling 110 formed proximate the first end 66. The rotational coupling 110 defines a first axis of rotation 114, around which the door 18 can pivot. In the illustrated embodiment, the rotational coupling 110 includes a shaft 118, which is disposed below the planar portion 86 of the door 18 along the bottom surface 98. In the illustrated embodiment, the planar portion 86 extends beyond the shaft 118 (i.e., in the direction of the first end 66) to form a flange 122 at the first end 66 of the door 18. The shaft 118 extends longitudinally between the first side 74 and the second side 78 to form the first axis of rotation 114. In the illustrated embodiment, the shaft 118 is generally cylindrical and includes a bore 126 (see FIG. 5) formed at each of the axial ends of the shaft 118. The bores 126 open outwardly towards the first side 74 and the second side 78 of the door 18. The bores 126 are configured to receive pins 130 (see FIG. 8), around which the door 18 can rotate. The illustrated shaft 118 extends continuously between the first side 74 and the second side 78, and spans the entire width of the door 18.

In other embodiments, the shaft 118 can be other shapes or sizes. For example, the shaft 118 may be hollow and may have a square or a triangular cross section. In some embodiments, the shaft 118 may be positioned centrally between the first side 74 and the second side 78, and may not extend the entire distance between the first side 74 and the second side 78. In other embodiments, the shaft 118 may not be continuous, but rather may include two or more shafts 118 aligned along the first axis of rotation 114. Furthermore, in some embodiments, the rotational coupling 110 may not be a shaft 118 that extends longitudinally between the first side 74 and the second side 78. For example, the rotational coupling 110 may be a pair of tabs that extend below the planar portion 86 of the door 18 and include through holes that are aligned along the first axis of rotation 114. Similar to the bores 126 described above, the through holes can receive the pins 130, around which the door 18 can rotate. As will be appreciated, the rotational coupling 110 can be any mechanism capable of providing an axis of rotation around which the door 18 can rotate.

Figure 6:
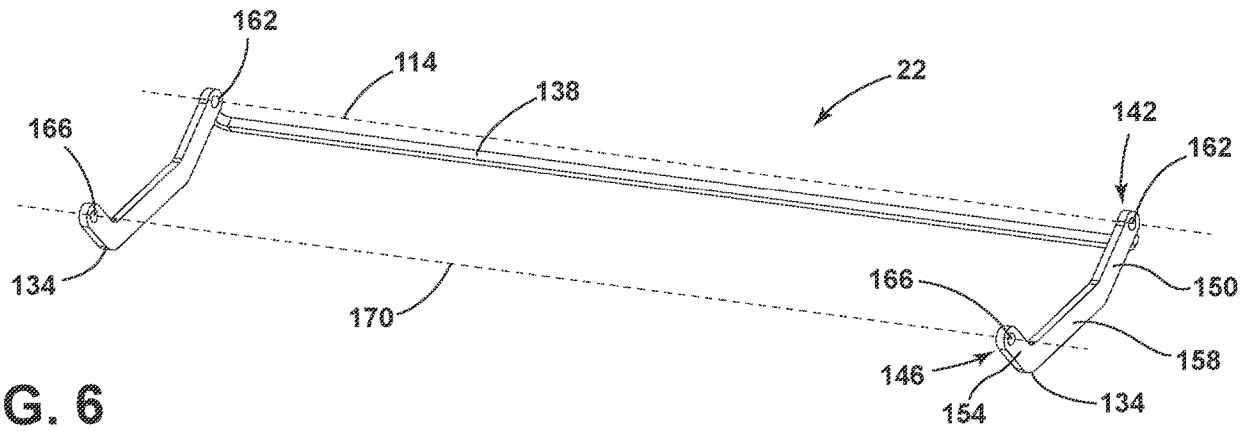
FIG. 6 is a perspective view of a hinge of the power access door assembly of FIG. 2.

The door 18 is rotatably coupled to the frame 14 by the hinge 22. As will be explained in greater detail below, the hinge 22 allows the door 18 to rotate relative to the frame 14 around two different axes of rotation. Referring to FIG. 6, the hinge 22 includes two lever arms 134 connected by a cross bar 138. The lever arms 134 each have a first end 142 and a second end 142. The cross bar 138 connects the first ends 142 of the lever arms 134. The lever arms 134 extend orthogonally from the cross bar 138 with the second ends 146 of the lever arms 134 remaining free from one another. In addition, the lever arms 134 are parallel to one another. In the illustrated embodiment, the lever arms 134 are each bent in two locations to essentially form three linkages. Accordingly, each lever arm 134 includes a first linkage 150 proximate the first end 142, a second linkage 154 proximate the second end 142, and a center linkage 158 extending between the first linkage 150 and the second linkage 154. The first linkage 150 and the second linkage 154 are oriented at non-parallel angles relative to the center linkage 158. In the illustrated embodiment, the first linkage 150 and the second linkage 154 are oriented at obtuse angles relative to the center linkage 158. Additionally, the angle formed between the first linkage 150 and the center linkage 158 is greater than the angle formed between the second linkage 154 and the center linkage 158. In other embodiments, the number of linkages can vary and the angles of the linkages relative to one another can also vary. Furthermore, the lever arms 134 each include a through hole on the first end 142, forming a first pivot point 162, and a through hole on the second end 142, forming a second pivot point 166. The first pivot point 162 of each lever arm 134 is aligned axially along the first axis of rotation 114. The second pivot point 166 of each lever arm 134 is aligned axially along a second axis of rotation 170.

Figure 7:
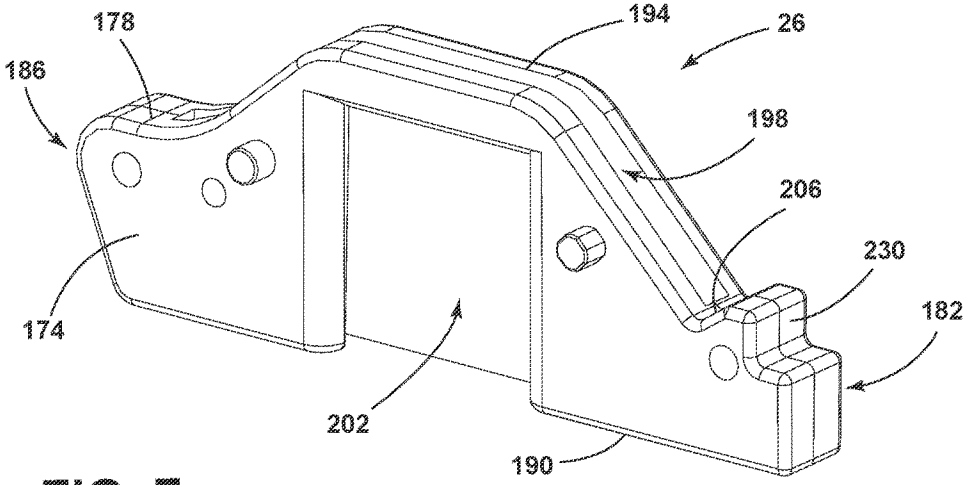
FIG. 7 is a perspective view of a support member of the power access door assembly of FIG. 2.
Figure 8:
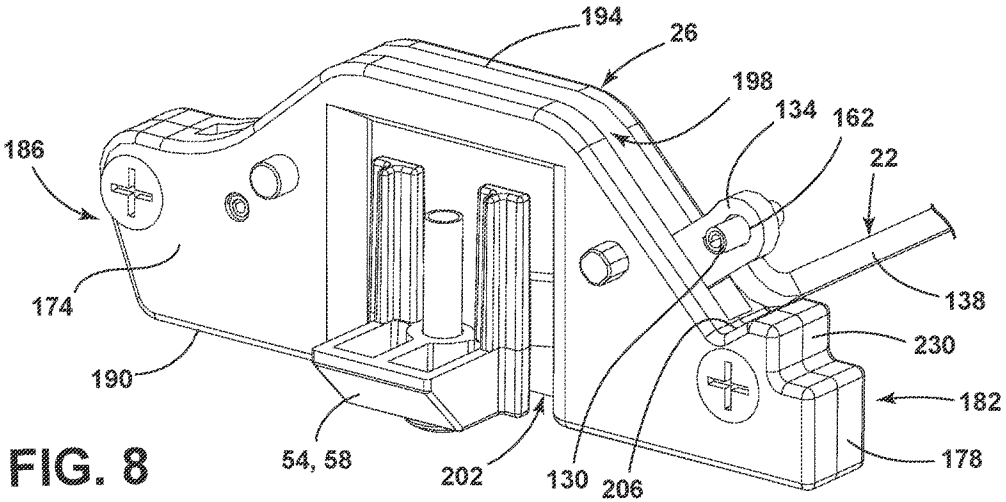
FIG. 8 shows the support member of FIG. 7 engaging with a clip and the hinge of FIG. 6.

The hinge 22 is rotatably coupled to the frame 14 via the support members 26. As shown in FIG. 3, the power access door assembly 1 includes two support members 26 that are coupled to the side panels 34 of the frame 14, respectively. Referring to FIGS. 7 and 8, each support member 26 includes opposing side walls 174 and a perimeter 178 extending between the side walls 174. The side walls 174 extend between a first end 182 and a second end 186 of the support member 26. The side walls 174 are spaced apart and are generally parallel to one another. The perimeter 178 is perpendicular to the side walls 174. The support member 26 includes a generally flat bottom 190 and a contoured top 194. Specifically, the perimeter 178 is contoured along the top 194 of the support member 26. The contour of the perimeter 178 is formed by a plurality of inclined surfaces. A channel 198 is positioned within the support member 26 between the side walls 174. An opening to the channel 198 is disposed on the top 194 of the perimeter 178. The channel 198 is sized and shaped to receive the lever arm 134 of the hinge 22.

In the illustrated embodiment, one of the side walls 174 includes a recess 202 (FIG. 7) that generally aligns with the recess 62 (FIG. 4) of the respective side panel 34. The recess 202 is configured to receive a fastener 54 that can couple the support member 26 to the frame 14 (FIG. 8). In the illustrated embodiment, the support members 26 are coupled to the frame 14 by the same fasteners 54 that support the frame 14 within the opening of the worksurface 10 (i.e., the clips 58). The clips 58 can engage with the frame 14 and the support members 26 to couple the support members 26 to the frame 14 and to support the frame 14 within the opening of the worksurface 10. In other embodiments, the support members 26 are coupled to the frame 14 by a different set of fasteners 54 than the ones used to support the frame 14 within the opening of the worksurface 10.

Figure 11:
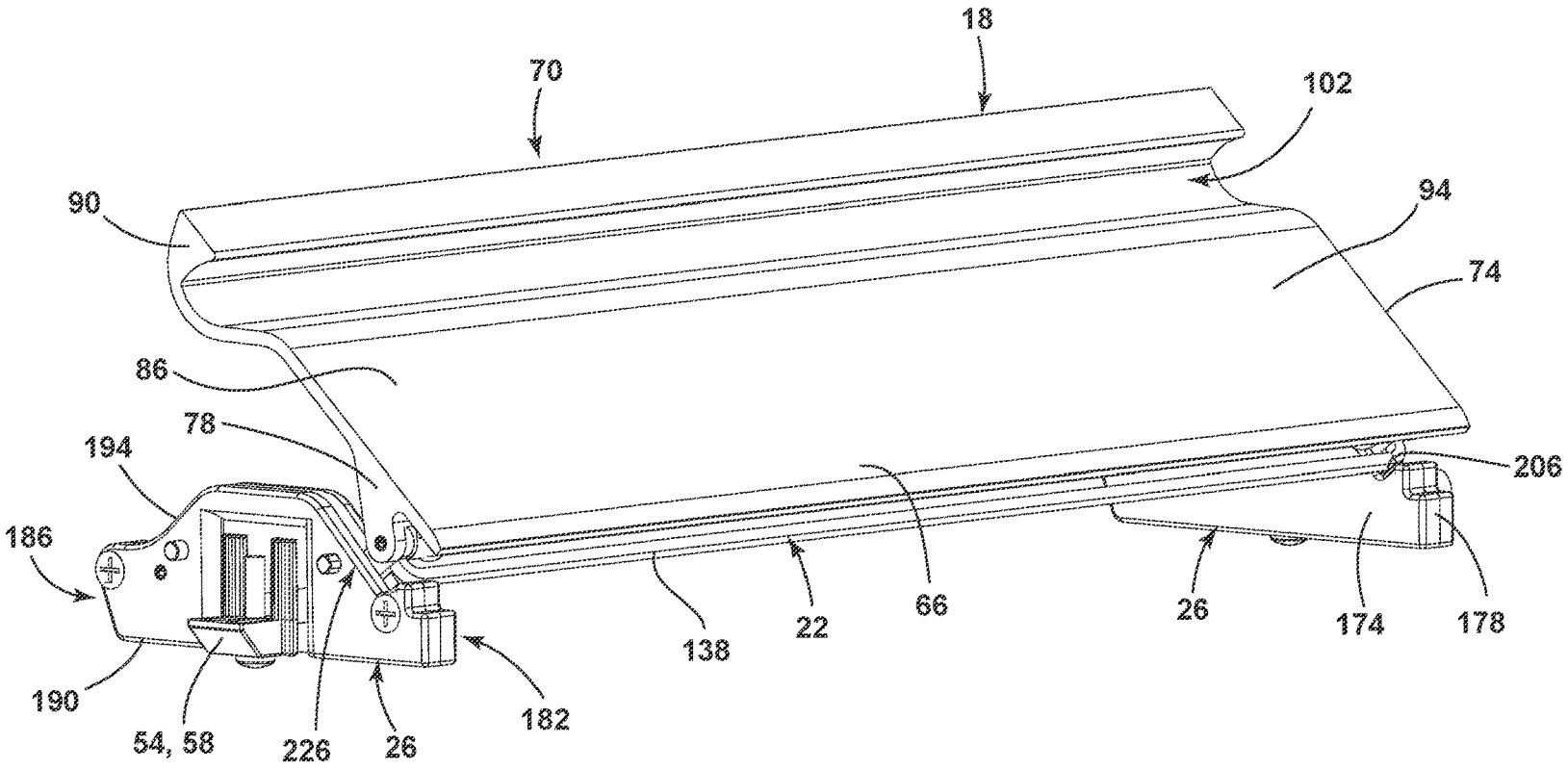
FIG. 11 is a perspective view of the power access door assembly of FIG. 2 with the frame removed.
Figure 12:
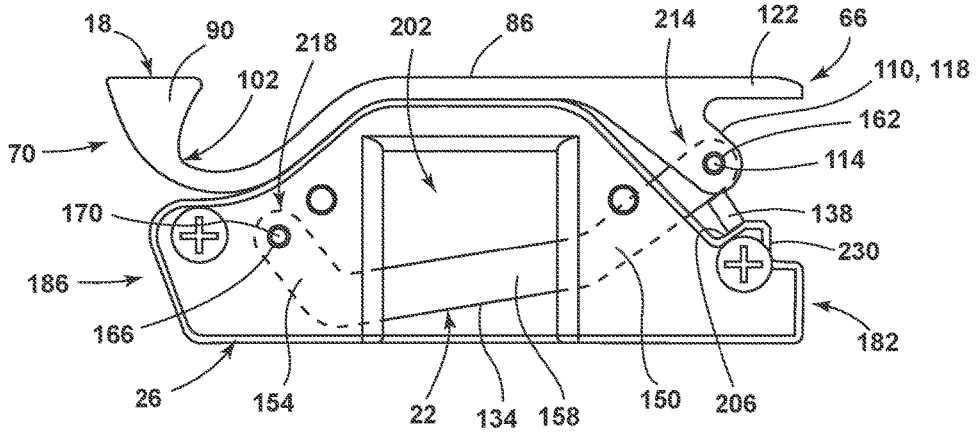
FIG. 12 is a side view of the power access door assembly of FIG. 2 in a first position.

When assembled, the support members 26 support the hinge 22 and the door 18 within the frame 14. Referring to FIG. 8, the lever arms 134 of the hinge 22 are received within the channels 198 of the support members 26. The cross bar 138 of the hinge 22 can rest on a first surface 206 defined by the perimeter 178 of the support members 26 (see FIGS. 11-13). As shown in FIG. 12, the door 18 can rest on the top 194 of the support member 26. In the illustrated embodiment, the perimeter 178 of the support member 26 is at least partially contoured to match the contour of the door 18. Specifically, at least a portion of the perimeter 178 is contoured to align with the bottom surface 98 of the planar portion 86 and the sloped surface 106 of the curved portion 90.

Figure 9:
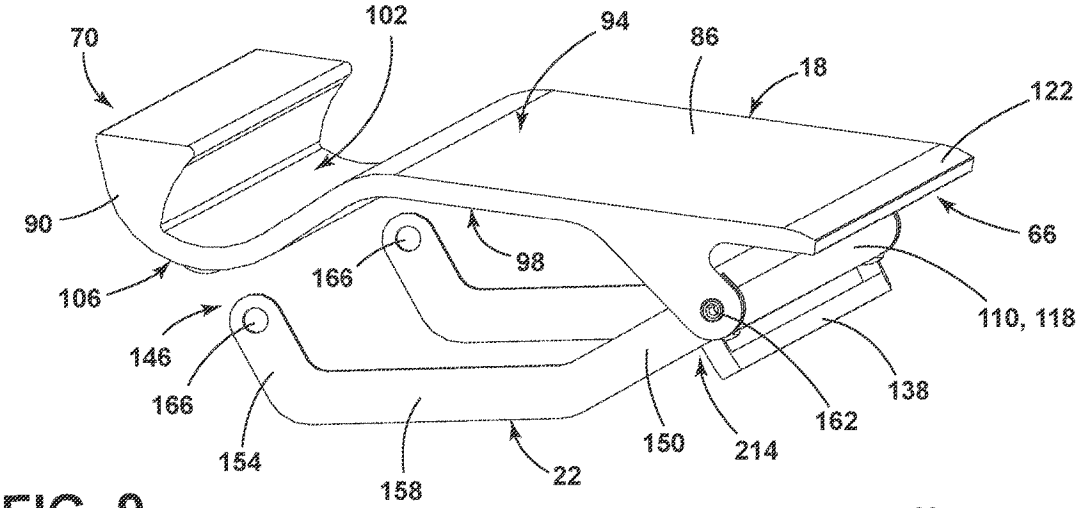
FIG. 9 is a perspective view of the hinge of FIG. 6 engaging with the door of FIG. 5.
Figure 10:
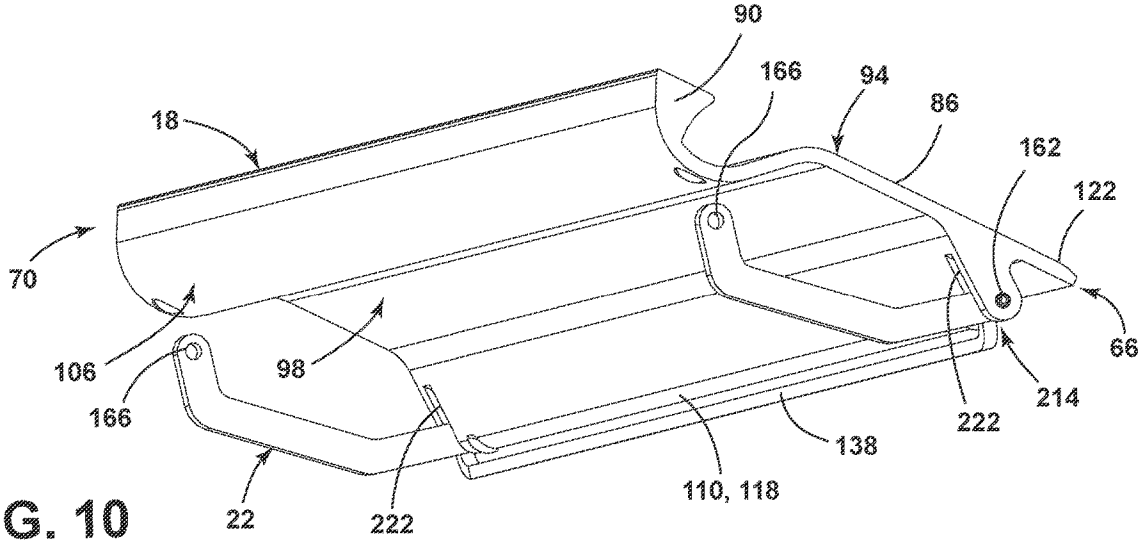
FIG. 10 is another perspective view of the hinge of FIG. 6 engaging with the door of FIG. 5.

In addition, when assembled, the hinge 22 rotatably couples the door 18 to the frame 14 such that the door 18 can rotate relative to the frame 14 around two different axis of rotation. First, as shown in FIGS. 9 and 10, the hinge 22 is rotatably coupled to the door 18 at a first joint 214, which allows the door 18 to rotate relative to the frame 14 about the first axis of rotation 114. The first joint 214 enables the door 18 to rotate relative to both the hinge 22 and the frame 14 about the first axis of rotation 114. Second, as shown in FIG. 12, the hinge 22 is rotatably coupled to the frame 14 at a second joint 218, to allow the door 18 to rotate relative to the frame 14 about the second axis of rotation 170. The second joint 218 enables both the door 18 and the hinge 22 to rotate relative to the frame 14 about the second axis of rotation 170.

To form the first joint 214, the hinge 22 engages with the rotational coupling 110 of the door 18. In the embodiment illustrated in FIGS. 9 and 10, the first ends 142 of the lever arms 134 are received within slots 222 (see FIG. 10) in the rotational coupling 110. When the first ends 142 are inserted into the slots 222, the first pivot points 162 are each aligned axially along the first axis of rotation 114, which extends longitudinally through the rotational coupling 110. The first joint 214 may include additional elements that aid in the rotation of the door 18 relative to the hinge 22. For example, the first joint 214 may include a pair of pins 130 that extend through the holes of the first pivot points 162 and into the bores 126 of the shaft 118. In other embodiments, the holes of the first pivot points 162 may be replaced by the pins 130, which are directly inserted into the bores 126 of the shaft 118. Furthermore, depending on the type of rotational coupling 110 used on the door 18, the first pivot points 162 may be created by other types of rotational mechanisms. For example, in some embodiments, the rotational coupling 110 of the door 18 may include a male part, such as a pin 130 or rod, and the first pivot points 162 of the hinge 22 may include bores 126 for receiving the pin 130 or rod.

The second joint 218 is formed by rotatably coupling the hinge 22 to the frame 14 via the support members 26. In the illustrated embodiment, the second pivot points 166 of the lever arms 134 are rotatably coupled to the support members 26 within the channels 198. Similar to the first joint 214, the second joint 218 may include additional elements. For example, in some embodiments, the lever arm 134 can be coupled to the support member 26 using a pin that extends through the hole on the second end 146 of the pivot arm. In other embodiments other types of rotating mechanisms can be used to couple the hinge 22 to the support members 26.

In operation, the hinge 22 can move the door 18 at the first joint 214 around the first axis of rotation 114, and can move the door 18 at the second joint 218 around the second axis of rotation 170. Movement of the first joint 214 and the second joint 218 enables the power access door assembly 1 to move between a series of different positions. FIGS. 12-17 illustrate the power access door assembly 1 as it transitions between these positions.

FIG. 12 illustrates the power access door 18 in a first position. In the first position, the first joint 214 and the second joint 218 are both closed. Accordingly, the hinge 22 and the door 18 both extend between the first end 182 and the second end 186 of the support members 26. The lever arms 134 of the hinge 22 are inserted into the channels 198 of the support members 26 and the cross bar 138 is resting on the first surface 206 of the support member 26. The door 18 is resting on the support member 26 with the bottom surface 98 and/or the sloped surface 106 engaging the perimeter 178 of the support member 26. In the first position, the power access door assembly 1 is closed such that the power outlets are hidden. In this position, the power cords may still pass through the power access door assembly 1 and be plugged into the power outlets. Specifically, the power cords extend through the space 82 (FIG. 2) formed between the door 18 and the frame 14. However, to plug and unplug the power cords, the power access door assembly 1 should be opened.

Figure 13:
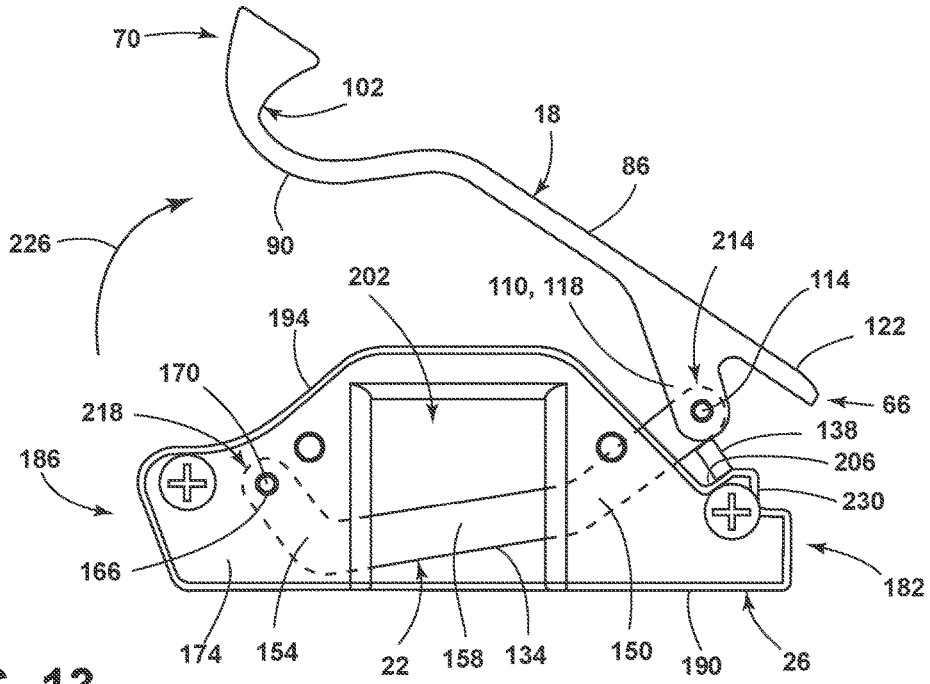
FIG. 13 is a side view of the power access door assembly of FIG. 2 in an intermediate position between the first position and a second position.
Figure 14:
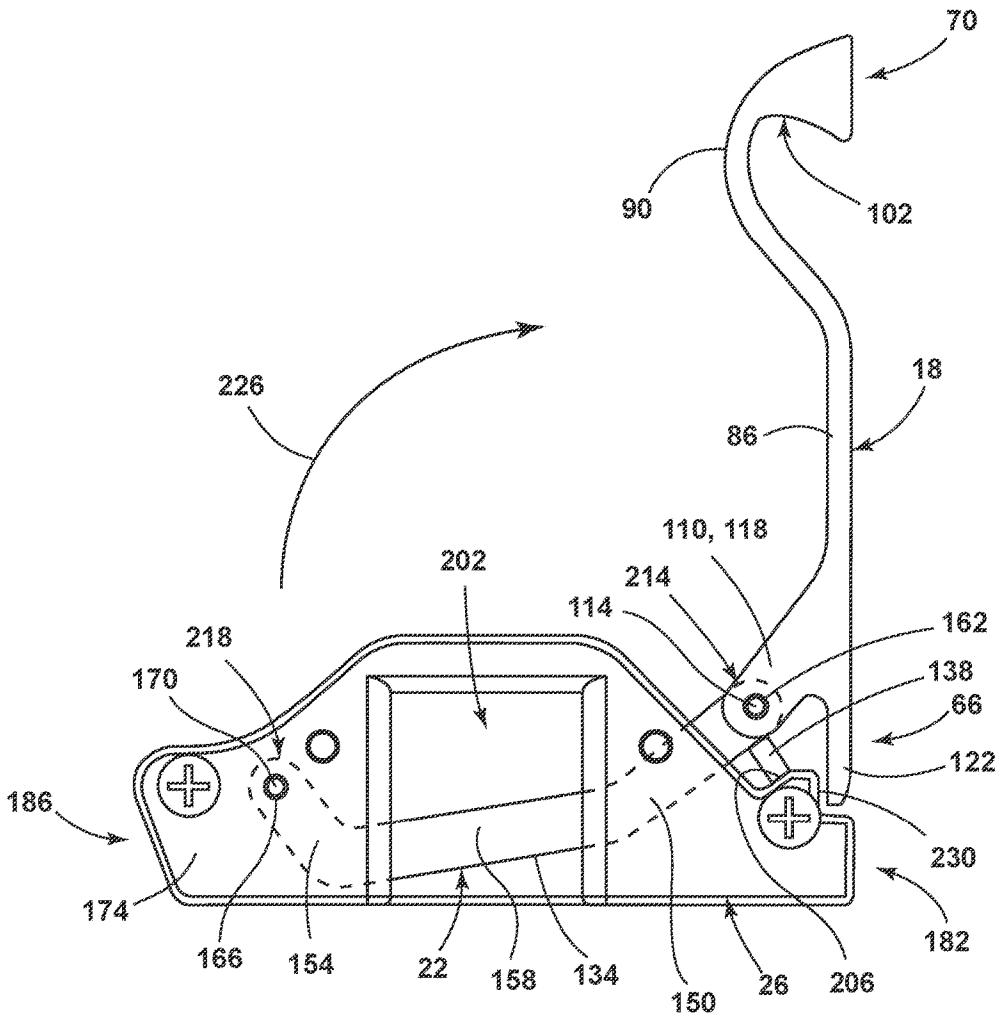
FIG. 14 is a side view of the power access door assembly of FIG. 2 in the second position.

FIGS. 13-17 illustrate the power access door 18 in various open positions. Referring to FIGS. 13 and 14, the door 18 can be moved to a second position. FIG. 13 illustrates the door 18 in an intermediate position between the first position and the second position. FIG. 14 illustrates the door 18 in the second position. In the second position, the first joint 214 is at least partially open and the second joint 218 remains closed. The hinge 22 remains in the same orientation as the first position, with the lever arms 134 of the hinge 22 inserted into the channels 198 of the support members 26 and the cross bar 138 resting on a first surface 206 of the support member 26. The hinge 22 continues to extend between the first end 182 and the second end 186 of the support member 26. The door 18 extends vertically upward in a direction generally orthogonal to the hinge 22.

To move from the first position to the second position, the door 18 is rotated in a first direction 226 (indicated by arrow 226) about the first axis of rotation 114. A user may grab onto the gripping surface 102 of the door 18 to help rotate the door 18 to the second position. In the illustrated embodiment, the door 18 is rotated until the flange 122 of the door 18 engages with a second surface 230 defined by the contoured perimeter 178 of the support member 26. The second surface 230 inhibits the door 18 from continuing to rotate about the first axis of rotation 114. In other embodiments, the flange 122 does not engage with a surface of the support member 26, and the door 18 may continue to rotate in the first direction 226. For example, in some embodiments, the first joint 214 can be rotated to a fully opened position. In the second position the power access door 18 is opened to reveal the power outlets. To move from the second position to the first position, the door 18 is rotated in a second direction, opposite the first direction 226, to close the door 18.

Figure 15:
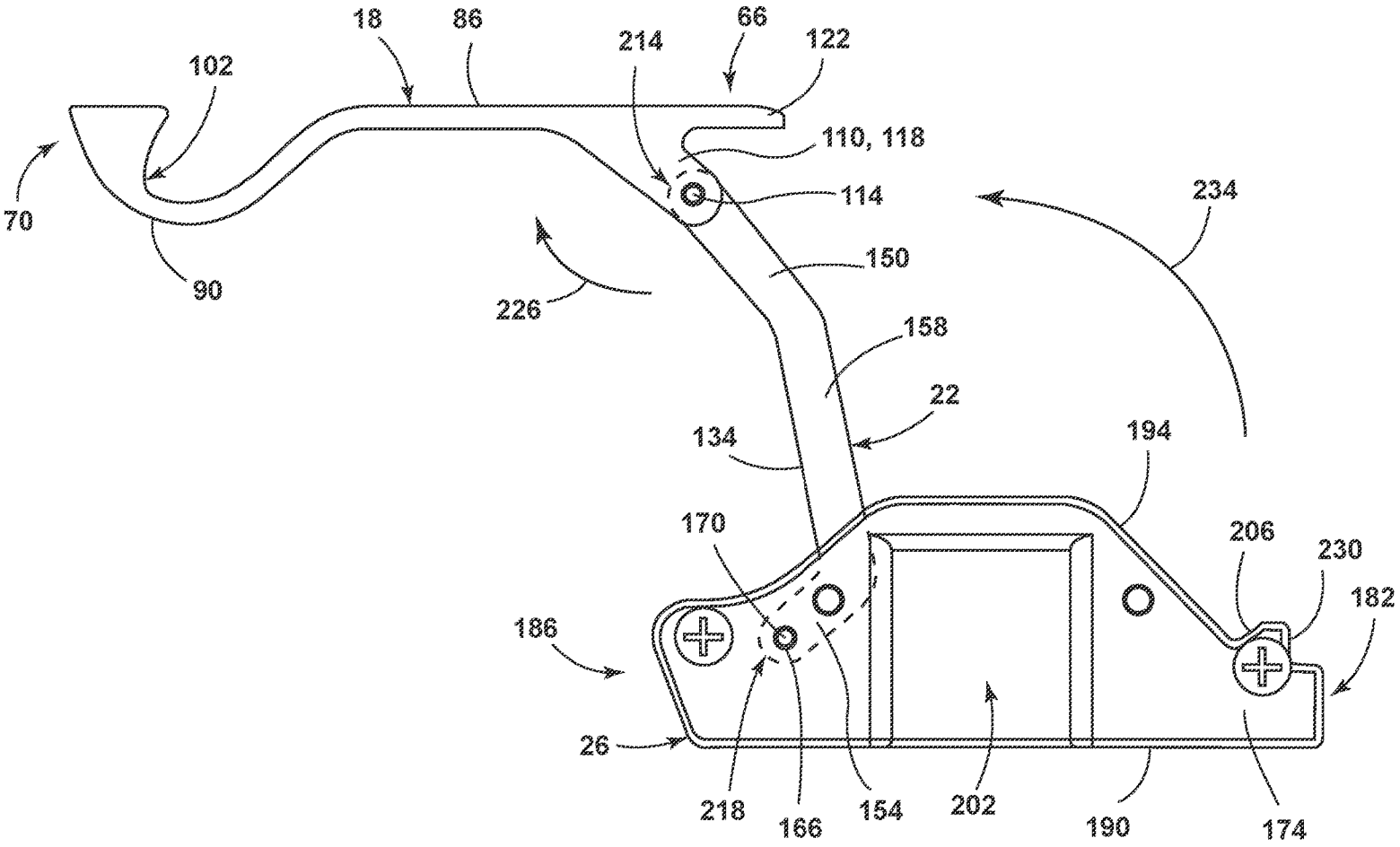
FIG. 15 is a side view of the power access door assembly of FIG. 2 in an intermediate position approaching a third position.
Figure 16:
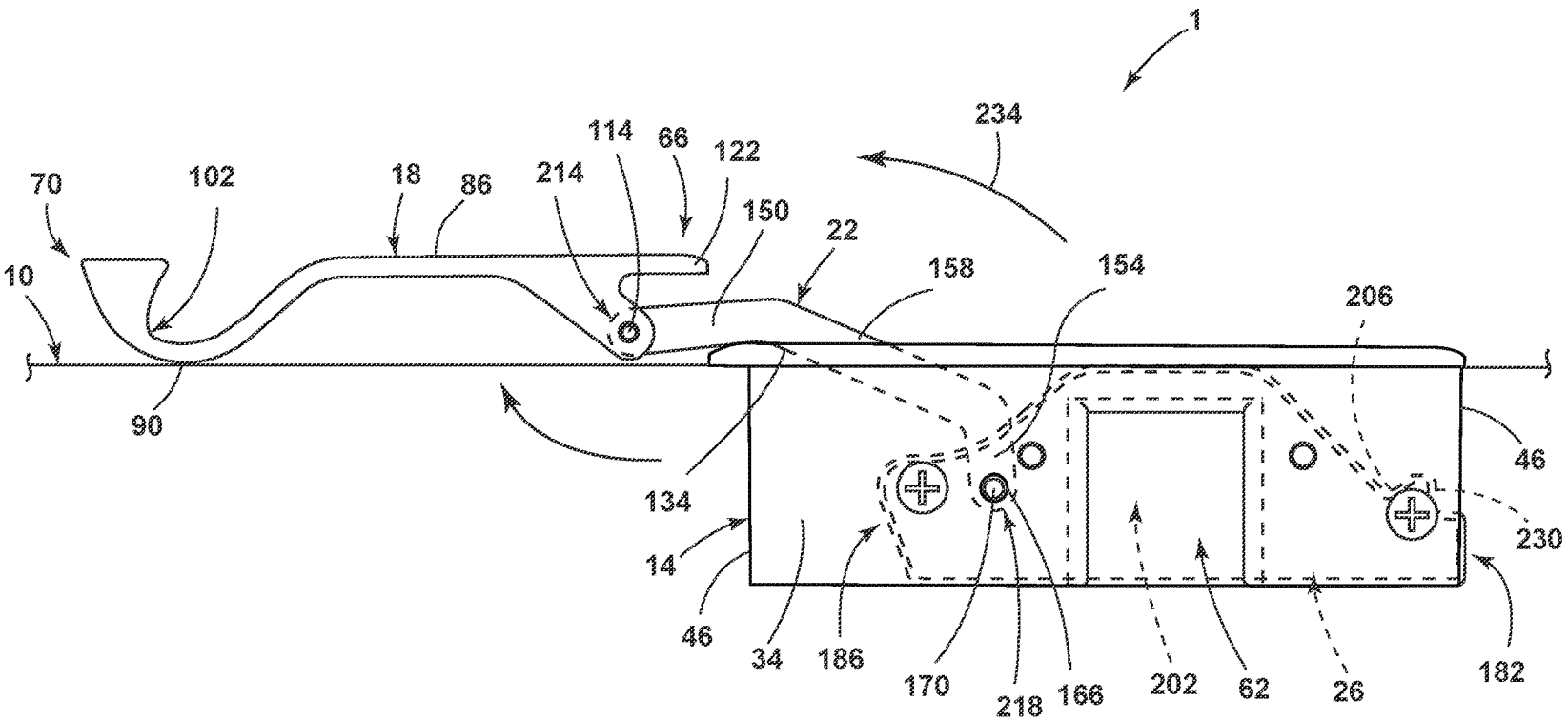
FIG. 16 is a side view of the power access door assembly of FIG. 2 in the third position.

FIGS. 15 and 16 illustrate the door 18 as it moves to a third position. FIG. 15 illustrates the door 18 in an intermediate position between the first position and the third position. FIG. 16 illustrates the door 18 in the third position. In the third position both the first joint 214 and the second joint 218 are fully opened. The hinge 22 and the door 18 are pulled entirely out of the perimeter of the frame 14 and can rest on the worksurface 10. The linkages 150, 154, 158 of the lever arms 134 allow the hinge 22 to extend up and out of the frame 14 while still enabling the door 18 to lay generally flat on the worksurface 10. To move from the first position to the third position, the door 18 is partially rotated in the first direction 226 about the first axis of rotation 114, and the hinge 22 (and door 18) is rotated in a first direction 234 about the second axis of rotation 170. A user may grab onto the gripping surface 102 of the door 18 and pull the door 18 outward so that the first joint 214 and the second joint 218 both open at the same time. Compared to the second position, the third position allows a user to access the power outlets beneath the power access door assembly 1 from either side. To move from the third position back to the first position, the user can again grab onto the gripping portion of the door 18, lift the door 18 and move the door 18 back to the first position. The first joint 214 and the second joint 218 can both close at the same time when returning to the first position.

Various features and advantages of the invention are set forth in the following claims.

What is claimed is:

1. A power access door assembly for use with a worksurface, the power access door assembly comprising:

a frame configured to be received within an opening of the worksurface;

a hinge coupled to the frame; and a door coupled to the hinge for movement relative to the frame, the door movable relative to the frame between a first position, in which the door is positioned within a perimeter of the frame and substantially blocks access to the opening, a second position, in which the door is pivoted open relative to the frame, and a third position, in which the door is moved outside the perimeter of the frame, wherein the hinge is coupled to the frame by a support member, and wherein the door rests on the support member when in the first position, and wherein the hinge includes a lever arm having a first end coupled to the door and a second end coupled to the frame, wherein the support member defines a slot, and wherein a majority of the lever arm is received in the slot when the door is in the first and second position.

2. The power access door assembly of claim 1, wherein the lever arm moves out of the slot as the door moves to the third position.

3. The power access door assembly of claim 1, wherein the door extends vertically upward in a direction generally orthogonal to the frame when in the second position.

4. The power access door assembly of claim 1, wherein the door is configured to lay substantially flat on the worksurface when in the third position.

5. The power access door assembly of claim 1, wherein the hinge defines a first axis of rotation and a second axis of rotation that is spaced apart from the first axis of rotation, wherein the door is coupled to the hinge at the first axis of rotation, and wherein the hinge is coupled to the frame at the second axis of rotation.

6. The power access door assembly of claim 5, wherein the door pivots relative to the hinge about the first axis of rotation as the door moves from the first position to the second position, and wherein the hinge pivots relative to the frame about the second axis of rotation as the door moves from the first position to the third position.

7. The power access door assembly of claim 6, wherein the hinge remains stationary relative to the frame as the door moves from the first position to the second position.

8. The power access door assembly of claim 1, wherein the frame defines a length and a width, and wherein when in the first position, the door spans the length of the frame and spans less than the width of the frame such that a space is defined between the door and the frame.

9. The power access door assembly of claim 1, wherein the door includes a curved portion defining a gripping surface to help move the door between the first, second, and third positions.

* * * * *